United States Patent [19]

Bremer et al.

[11] 4,338,851

[45] Jul. 13, 1982

[54] CARTRIDGE BELT GUIDING MECHANISM IN AN AUTOMATIC WEAPON, THE ELEVATION OF WHICH IS ADJUSTABLE

[75] Inventors: Clemens Bremer, Duesseldorf; Horst Menges, Ratingen, both of Fed. Rep. of Germany

[73] Assignee: Rheinmetall GmbH, Duesseldorf, Fed. Rep. of Germany

[21] Appl. No.: 190,419

[22] Filed: Sep. 24, 1980

[30] Foreign Application Priority Data

Dec. 4, 1979 [DE] Fed. Rep. of Germany ..... 2948685

[51] Int. Cl.[3] ..... F41D 10/40

[52] U.S. Cl. ..... 89/33 BB; 193/25 AC; 193/25 S

[58] Field of Search ..... 89/33 BB; 193/25 R, 193/25 AC, 25 S

[56] References Cited

FOREIGN PATENT DOCUMENTS 590783 7/1947 United Kingdom ..... 193/25 AC

*Primary Examiner*—Stephen C. Bentley

[57] ABSTRACT

A cartridge belt guiding mechanism for automatic weapons disposed between the outlet of an ammunition belt storage container and the ammunition belt inlet of the automatic weapon. The guiding mechanism is composed of a plurality of open frame-like elements. Each element has a plurality of pins extending from opposite faces thereof. Coil springs are mounted on the pins and are connected to confronting faces of the frame-like elements. The coil springs define a flexible guide channel adapted slidingly guide therethrough the cartridges of the ammunition belt. The end elements of the channel are respectively connected to the outlet of the ammunition belt storage container and the ammunition belt inlet of the automatic weapon.

4 Claims, 4 Drawing Figures

CARTRIDGE BELT GUIDING MECHANISM IN AN AUTOMATIC WEAPON, THE ELEVATION OF WHICH IS ADJUSTABLE

BACKGROUND OF THE INVENTION

The invention pertains to an ammunition belt guiding mechanism for automatic weapons. Ammunition belt guiding mechanisms form part of the state of the art and are, for example, described in German Pat. No. DE-PS No. 10 64 390. A flexible belt channel is provided by means of coil springs which bear against the belted cartridges between the outlet of an ammunition belt storage container and the inlet of an automatic weapon. This known arrangement is advantageously simple and renders the possibility to pull the ammunition belt in a direction opposite to the transport direction without the danger of jamming, but also has the drawback that with this known cartridge belt guiding mechanism only a relatively small distance is bridged between the ammunition storage container and the inlet of the belt in the automatic weapon. In addition thereto, this known ammunition belt guiding mechanism does also not provide protection against a displacement of the ammunition belt in the firing direction transversely in the transport direction which is an additional drawback.

SUMMARY OF THE INVENTION

It is an object of this invention to provide an ammunition belt guiding mechanism of the afore-described type, which is of simple construction and is adaptable in a reliable manner for an arrangement wherein an increased distance between the ammunition storage container and the belt inlet in the automatic weapon is provided.

This arrangement of the invention is characterized in that advantageously it is adaptable for an increased range of different caliber ammunitions.

BRIEF DESCRIPTION OF THE DRAWING

These and other objects of the invention are realized and illustrated in the several preferred embodiments shown in the accompanying drawings.

DETAILED DESCRIPTION

Figure 1:
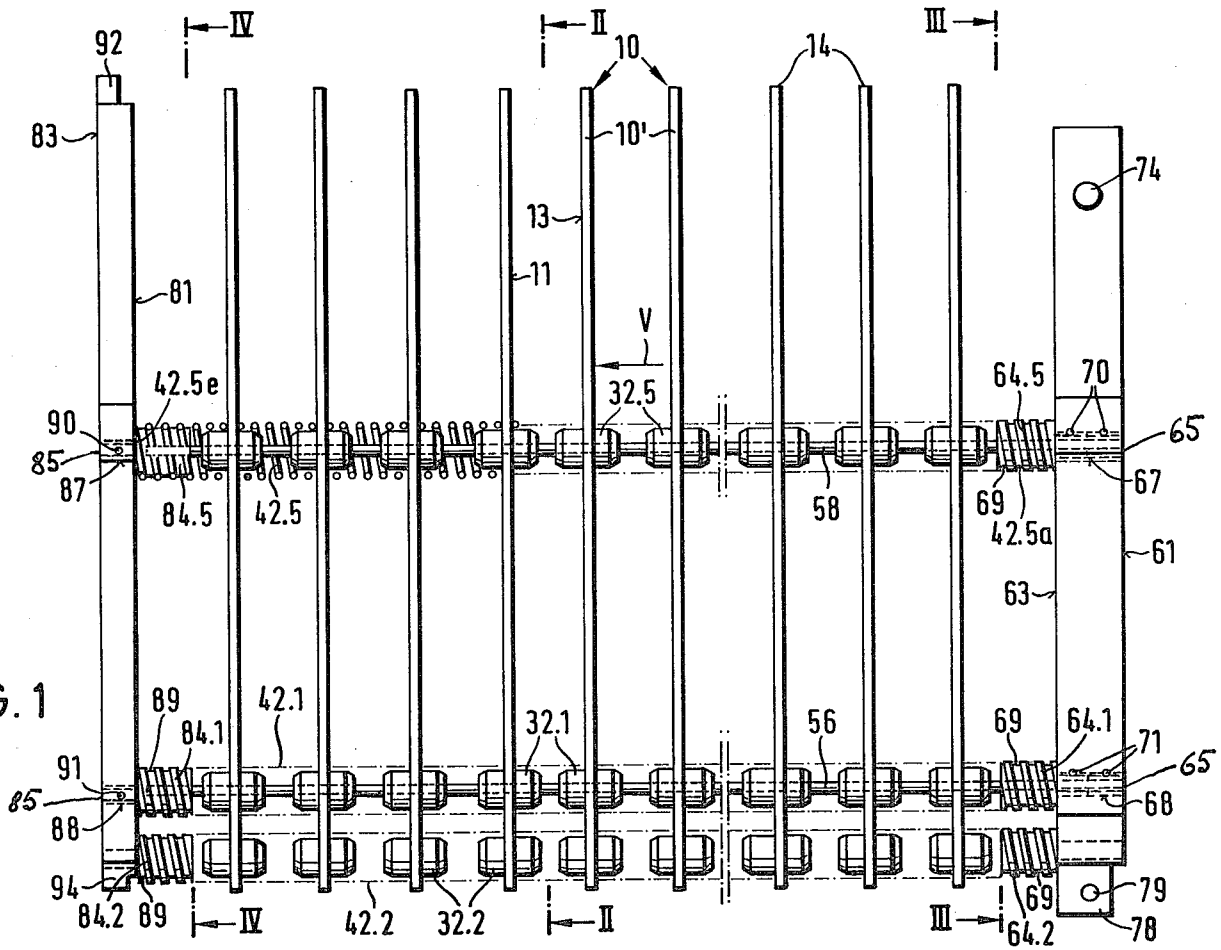
FIG. 1 is a plan view seen from above of an ammunition belt guiding mechanism in accordance with the invention in a stretched condition.
Figure 3:
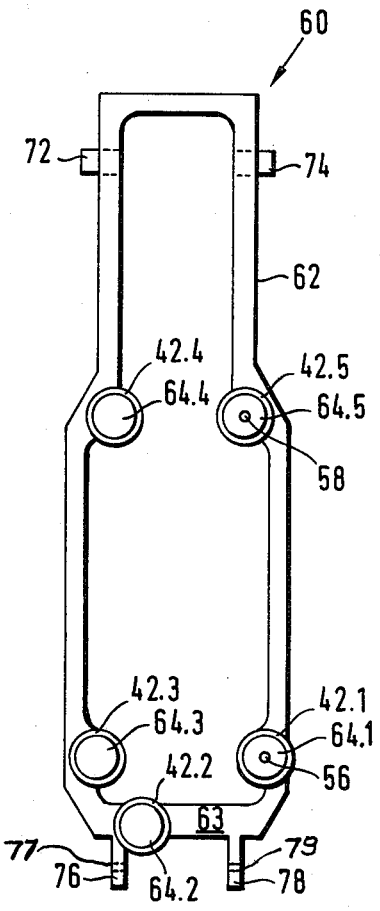
FIG. 3 is a side-elevational view of the ammunition belt guiding mechanism of the invention along line III—III in FIG. 1.
Figure 4:
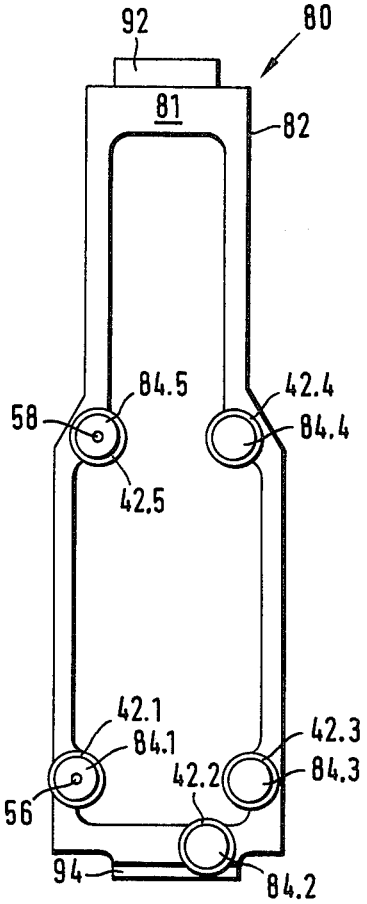
FIG. 4 is a side-elevational view of the ammunition belt guiding mechanism of the invention along IV—IV in FIG. 1.

As illustrated in FIG. 1 a predetermined number of elements 10 are arranged side by side at a predetermined distance from each other. The right end of the guide mechanism of the invention is connected to an element 60 (see FIG. 3) at the outlet side of a non-illustrated ammunition storage container, whereas the left end is connected to an element 80 (see FIG. 4) of a non-illustrated inlet of an ammunition belt inlet in an automatic weapon. The element 10 is made up essentially out of a flat frame 10' from the front faces 11 and 13 of which guide members 32.1 to 32.5 project and act as pivot supports (FIG. 1). The exterior diameter $d_{fa}$ of the guide members 32.1 to 32.5 correspond to the internal diameter $d_{si}$ of the coil springs 42.1 to 42.5, which connect the elements 10 at a predetermined distance to each other. The elements 60 (80) having the face 63 (81) confronting the face 11 (13) has guide members 64.1 to 64.5 (84.1 to 84.5) projecting therefrom, each of which is provided with a threaded portion 69 (89) mating with a coil spring 42. The guide members 64 (84) are detachably mounted in the element 60 (80) by means of transversely inserted pins 70 and 71 (90 and 91) which fit loosely into bores 67 and 68 (87 and 88) on elements 60 (80) into which mating pins 65 (85) of guide members 64 (84) project. For example, these pivot pins 65 (85) can be mounted by means of non-illustrated headless screws into the members 60 (80). The guide member 64 (84) can be advantageously screwed in at the ends **42*a* (42*e*) of the coil springs 42 and thereafter be connected to the element 60 (80). The element 60 (80) are formed as closed frames 62 (82) which can be respectively detachably connected with the non-illustrated outlet of an ammunition storage container (the non-illustrated inlet for the ammunition belt in the side of the automatic weapon) by means of pins 72 and 74 and eyes 77 and 79 provided on the projections 76 and 78 (projections 92 and 94**).

Figure 2:
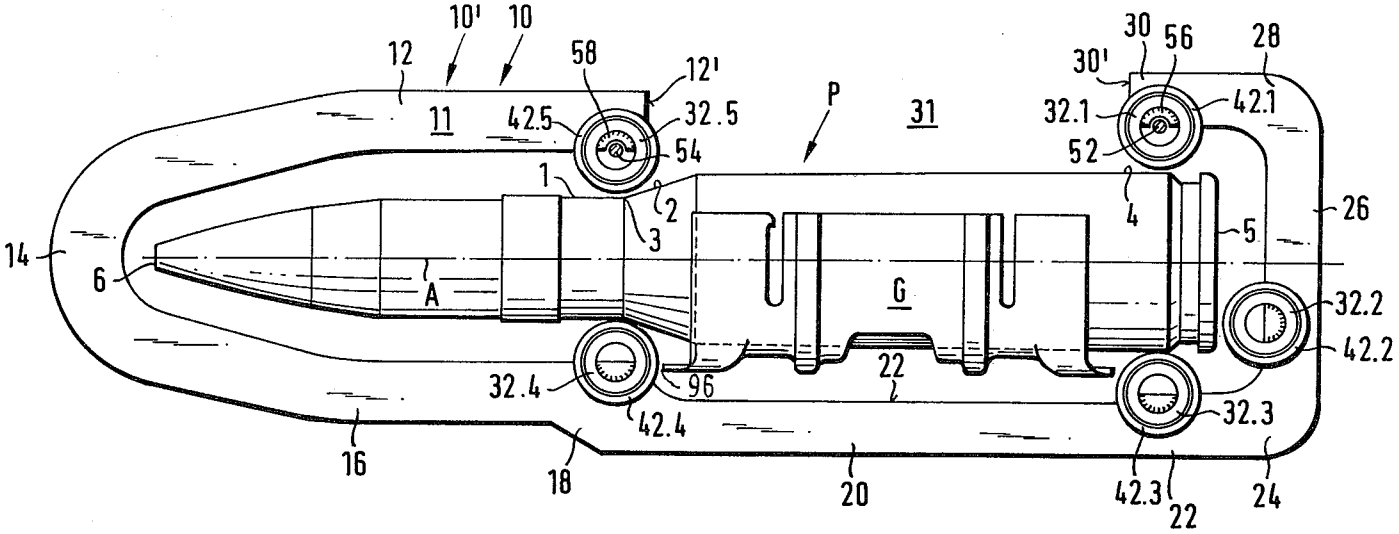
FIG. 2 is a side-elevational view along line II—II of FIG. 1 wherein a cartridge and a belt member are illustrated in side-elevation at an enlarged scale.

The flat frame 10' of the element 10 is composed of a forwardly extending upper portion 12 having a narrow end surface 12'. The upper portion 12 is connected via an arcuate forward portion 14 to the underportion 16. A transfer portion 18 adjoins the underportion 16 and connects it to intermediate portion 20, the latter being connected by means of a wider transfer portion 22 to the rear angular portion 24. To the latter there is connected the rearward transverse portion 26 which ends in a forward upward angled portion 28. The latter upward angled portion 28 is connected to a rear upper portion 30 which terminates in a narrow end surface 30'. There is therefore provided an empty space 31 between the narrow end surfaces 30' and 12'. The frame 10' surrounds a cartridge P of longitudinal axial contour, which is illustrated jointly with a belt member G in a side-elevational view in FIG. 2. A throat 3 is disposed between a circular cylindrical peripheral surface 1 and a conical peripheral surface 2 of the cartridge P. In the region of the upper part 12 and the transfer section 18 of frame 10' guide members 32.5 and 32.4 engage the cartridge P with their corresponding coil springs 42.5 and 42.4. The intermediate portion 20 of the flat frame 10' extends between the guide member 32.4 and the adjacent guide member 32.3 both of which are mounted on the lower leg of the guide member 10 (see FIG. 2) and between which the inner surface 22' of the portion 22 extends, said surface serving to maintain the distance from the belt members G. The guide member 32.3 supports via the coil spring 42.3 the cartridge P at its lower side in a region adjacent to the bottom of the cartridge and a corresponding guidance is carried out by means of the guide member 32.1 and the coil spring 42.1 near the narrow end surface 30'. The guide member 32.2, mounted upwardly from the upwardly angled position 24 serves to guide with its coil spring 42.2 the cartridge bottom 5. By means of the guide members 32.5 and 32.5 the cartridge P with its bullet point 6 aligned in the direction of the longitudinal axis A is maintained at a distance from the forward arcuate portion 14 of the frame 10'; a certain play of the cartridge P in the member 10 is permitted by the conical peripheral surface 2. In the opposite direction a deviation of the cartridge P is prevented by means of the guide member 32.2 having the coil spring 42.2 mounted theron. As has been described hereinabove, the coil springs 42.1 to 42.5 extend from surface 11 to surface 13 (respectively 13 to 81 and 11 to 63), so that a flexible and flawfree belt guidance in a belt channel is formed jointly with the two end elements 60 and 80. As is illustrated in the drawing, the guide members 32.1 and 32.5, 64.1 and 64.5, as well as 84.1 and 84.5 are provided with bores through which cable wires 56, 58, forming an excessive stretch security, extend. This cable or wire 56, 58 is secured to the end element 60 and 80 in a manner which has not been illustrated in detail. By means of the excessive stretch security 56, 58 the length of the belt channel is predetermined. In this way the coil springs 42.1 to 42.5 can be divided in such a way, so that parts thereof only extend between the faces 63 and 11, 13 and 11 and 13 and 81. In such an arrangement the individual elements 10 can be exchanged, if necessary, in a particularly simple manner. As has been already described hereinabove, a cartridge belt can be pulled opposite to the general transport direction V (for example when removing the cartridge belt from the belt guiding mechanism), without fear of jamming. In double belt guiding the cartridge belt guiding on the left side needs only to be differentiated from that on the right side (a cartridge belt guiding for a right side inlet is illustrated in FIG. 1) by forming the elements 60 and 80 in a mirror-like fashion. Although the cartridge belt guiding mechanism is illustrated with two excessive stretch securities 56 and 58 as well as with welded-on guide members 32.1 to 32.5, it is within the scope of this invention to provide further or other wires disposed otherwise to provide excessive stretch security arrangements, as well as elements 10 with the guide members 32.1 and 32.5 in a corresponding fabrication process (for example finely cast) can be originally provided. In each case the cartridge belt guiding mechanism can be fabricated in accordance with the invention in an extremely easy and simple fashion and can be adapted to the prevailing conditions in all cases.

If necessary the guide members 32 can be otherwise arranged. In the present case, it has been found advantageous that the guide member 32.2 is arranged about opposite the lower portion of the cartridge bottom 5, because thereby a damaging frictional sliding contact in the region of the ignition cap is avoided. The position of the guide member 32.4 has also proven to be advantageous, because, due to being arranged closely adjacent to the edge 96 of the belt member G, the outer region of the coil spring 42.4 assembly of belt and cartridge receives an axial fixing with respect to the axis A with a slight play.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. A cartridge belt guiding mechanism for automatic weapons disposed between the outlet of an ammunition belt storage container and an ammunition belt inlet of the automatic weapon, comprising in combination, a plurality of elements which at least partially surround the longitudinal axial contour of the cartridge at a predetermined distance therefrom, each element having a plurality of guide members mounted thereon, coil springs mounted on said guide members and connecting adjacent elements to each other and being adapted to slidingly guidingly engage the cartridge passing through the corresponding element so as to form a flexible guide channel for the ammunition belt from the outlet of the ammunition belt storage container to the inlet for the ammunition belt in the automatic weapon, the elements forming the ends of said channel being respectively connected to said outlet and inlet.

2. The cartridge belt guiding mechanism for automatic weapons as set forth in claim 1, wherein (a) said elements have substantially indentical frame-like shapes having confronting face surfaces and (b) said guide members being formed as pins extending from said confronting face surfaces, the outer diameter of said pins corresponding substantially to the inner diameter of said coil springs.

3. The cartridge belt guiding mechanism for automatic weapons as set forth in claim 2, including excessive stretch preventing means detachably connected to said elements of said channel and determining the length thereof.

4. The cartridge belt guiding mechanism for automatic weapons as set forth in claim 3, wherein said excessive stretch preventing means is at least one cable, and wherein a preselected number of said pins form at least one row of aligned pins each of which has a bore, said cable extending through said bores of said aligned pins and being detachably connected to said end elements of said guide channel.

* * * * *